US010474047B2

(12) United States Patent
Xu et al.

(10) Patent No.: US 10,474,047 B2
(45) Date of Patent: Nov. 12, 2019

(54) TONER SET, IMAGE FORMING METHOD, AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Li Xu, Shizuoka (JP); Maiko Miyoshi, Shizuoka (JP); Taishi Takano, Shimizu Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/872,666

(22) Filed: Jan. 16, 2018

(65) Prior Publication Data

US 2019/0018330 A1 Jan. 17, 2019

(30) Foreign Application Priority Data

Jul. 14, 2017 (JP) ..... 2017-138083

(51) Int. Cl.

| | |
|---|---|
| ***G03G 9/09*** | (2006.01) |
| ***G03G 9/08*** | (2006.01) |
| ***G03G 9/087*** | (2006.01) |
| ***G03G 15/01*** | (2006.01) |

(52) U.S. Cl.

CPC ..... *G03G 9/0902* (2013.01); *G03G 9/0819* (2013.01); *G03G 9/08755* (2013.01); *G03G 9/0926* (2013.01); *G03G 15/0126* (2013.01); *G03G 15/0152* (2013.01)

(58) Field of Classification Search

CPC ..... G03G 9/0902; G03G 15/0152; G03G 9/08755; G03G 9/0819

See application file for complete search history.

(56) References Cited

U.S. PATENT DOCUMENTS

2014/0023964 A1* 1/2014 Hirai ..... G03G 9/09 430/105

2016/0070190 A1 3/2016 Ishikawa et al.

* cited by examiner

*Primary Examiner* — Thorl Chea

(74) *Attorney, Agent, or Firm* — Foley & Lardner LLP

(57) ABSTRACT

Provided here are toner sets and image forming apparatus and methods for the formation of a bright image with excellent brightness and concealability. A toner set according to an embodiment comprises a first toner which is stored in a first container and comprises a plurality of first toner particles containing a first bright pigment and a first binder resin, and a second toner which is stored in a second container and comprises a plurality of second toner particles containing a second bright pigment and a second binder resin, wherein the second toner has a larger volume average particle diameter than the first toner.

10 Claims, 3 Drawing Sheets

TONER SET, IMAGE FORMING METHOD, AND IMAGE FORMING APPARATUS

CROSS-REFERENCE TO RELATED APPLICATIONS

This application claims the benefit of priority from Japanese Patent Application No. 2017-138083, filed Jul. 14, 2017, the entire contents of which are incorporated herein by reference.

FIELD

Embodiments described herein relate to a toner set, an image forming method, and an image forming apparatus.

BACKGROUND

With the recent diversification of the printed matter, there is a demand for a toner containing a pigment having brightness such as metallic luster or pearly luster as a colorant.

DETAILED DESCRIPTION

Figure 1:
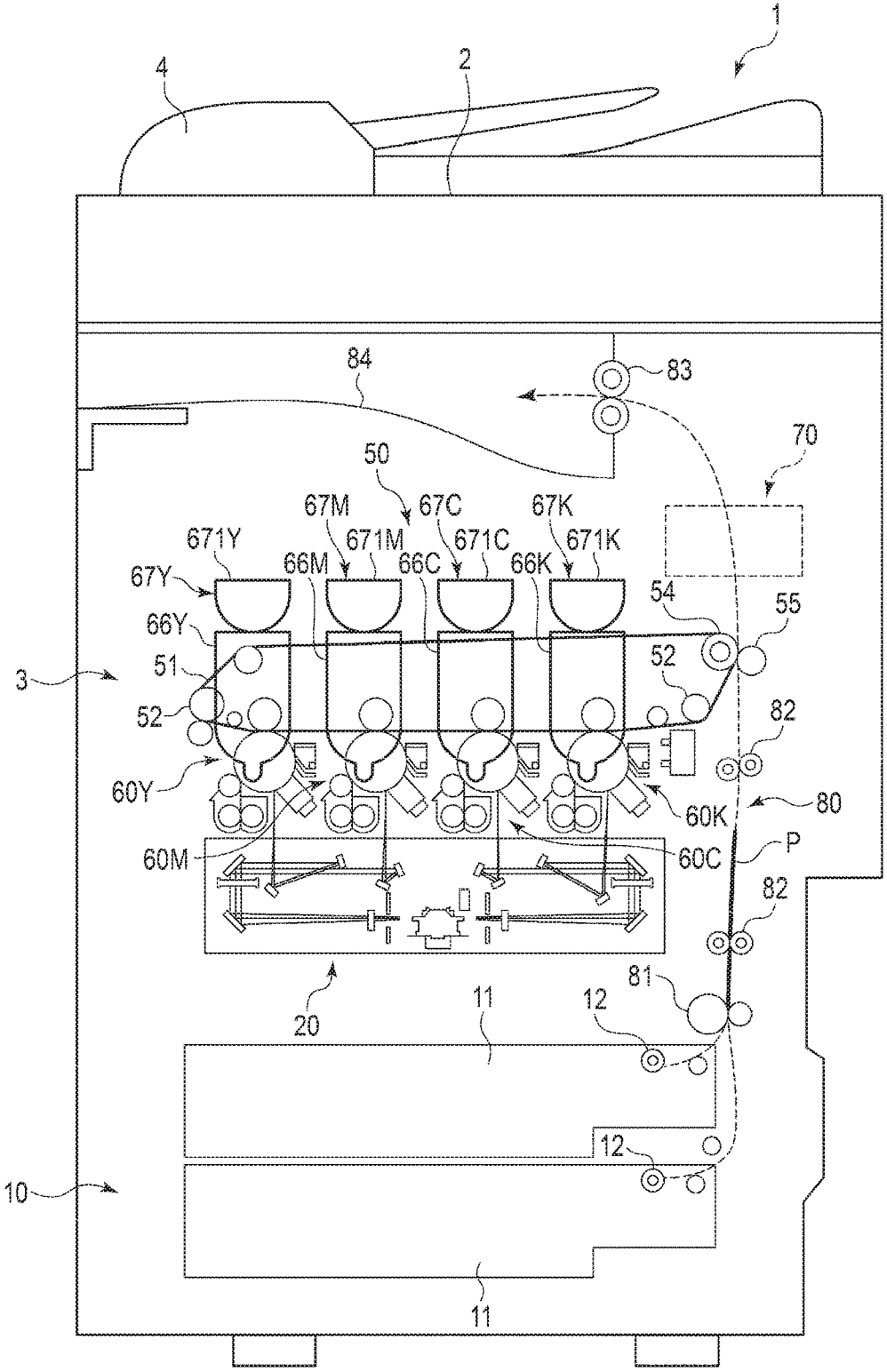
FIG. 1 is a cross-sectional view schematically showing an example of an image forming apparatus.

Hereinafter, embodiments will be described with reference to the drawings. Incidentally, components having the same or similar functions are denoted by the same reference numerals, and repetitive explanations will be omitted.

An object of some embodiments described herein is to provide toner sets and image forming apparatus and methods for the formation of a bright image with excellent brightness and concealability.

A toner set according to a first embodiment includes a first toner which is stored in a first container and includes a plurality of first toner particles containing a first bright pigment and a first binder resin, and a second toner which is stored in a second container, includes a plurality of second toner particles containing a second bright pigment and a second binder resin, and has a larger volume average particle diameter than the first toner.

An image forming method according to a second embodiment includes forming a first electrostatic latent image on a first photoconductor, forming a first toner image corresponding to the first electrostatic latent image on the first photoconductor by supplying a first toner which includes a plurality of first toner particles containing a first bright pigment and a first binder resin to the first photoconductor, directly or indirectly transferring the first toner image onto a recording medium from the first photoconductor, forming a second electrostatic latent image having the same shape and dimension as the first electrostatic latent image on the first photoconductor or a second photoconductor which is different from the first photoconductor, forming a second toner image corresponding to the second electrostatic latent image on the first or second photoconductor by supplying a second toner which includes a plurality of second toner particles containing a second bright pigment and a second binder resin and has a larger volume average particle diameter than the first toner to the first or second photoconductor having the second electrostatic latent image formed thereon, and forming a bright image in which the first and second toner images are superimposed on each other on the recording medium by directly or indirectly transferring the second toner image onto the recording medium from the first or second photoconductor.

An image forming apparatus according to a third embodiment includes one or more photoconductors, one or more chargers which charge the one or more photoconductors, an optical unit which irradiates the one or more photoconductors with light, thereby forming first and second electrostatic latent images, a first developing device which supplies a first toner including a plurality of first toner particles containing a first bright pigment and a first binder resin to one of the one or more photoconductors, thereby forming a first toner image corresponding to the first electrostatic latent image, a second developing device which supplies a second toner including a plurality of second toner particles containing a second bright pigment and a second binder resin and having a larger volume average particle diameter than the first toner to one of the one or more photoconductors, thereby forming a second toner image corresponding to the second electrostatic latent image, a transfer device which directly or indirectly transfers the first and second toner images onto a recording medium from the one or more photoconductors, and a control unit which controls the operation of the optical unit so that the first and second electrostatic latent images have the same shape and dimension, and also controls the operation of the transfer device so that the first and second toner images are superimposed on each other on the recording medium to form a bright image.

Examples of a bright pigment described herein include mica coated with a metal oxide and an aluminum pigment. In some embodiments, the bright pigment can have a flat plate shape, and the principal plane thereof functions as a reflective surface. Therefore, as the particle diameter of the bright pigment becomes larger, the bright pigment can exhibit metallic luster or pearly luster more strongly.

<<Image Forming Apparatus>>

An image forming apparatus according to an embodiment includes one or more photoconductors, one or more chargers which charge the one or more photoconductors, an optical unit which irradiates the one or more photoconductors with light, thereby forming first and second electrostatic latent images, a first developing device which supplies a first toner including a plurality of first toner particles containing a first bright pigment and a first binder resin to one of the one or more photoconductors, thereby forming a first toner image corresponding to the first electrostatic latent image, a second developing device which supplies a second toner including a plurality of second toner particles containing a second bright pigment and a second binder resin and having a larger volume average particle diameter than the first toner to one of the one or more photoconductors, thereby forming a second toner image corresponding to the second electrostatic latent image, a transfer device which directly or indirectly transfers the first and second toner images onto a recording medium from the one or more photoconductors, and a control unit which controls the operation of the optical unit so that the first and second electrostatic latent images have the same shape and dimension, and also controls the operation of the transfer device so that the first and second toner images are superimposed on each other on the recording medium to form a bright image.

Figure 2:
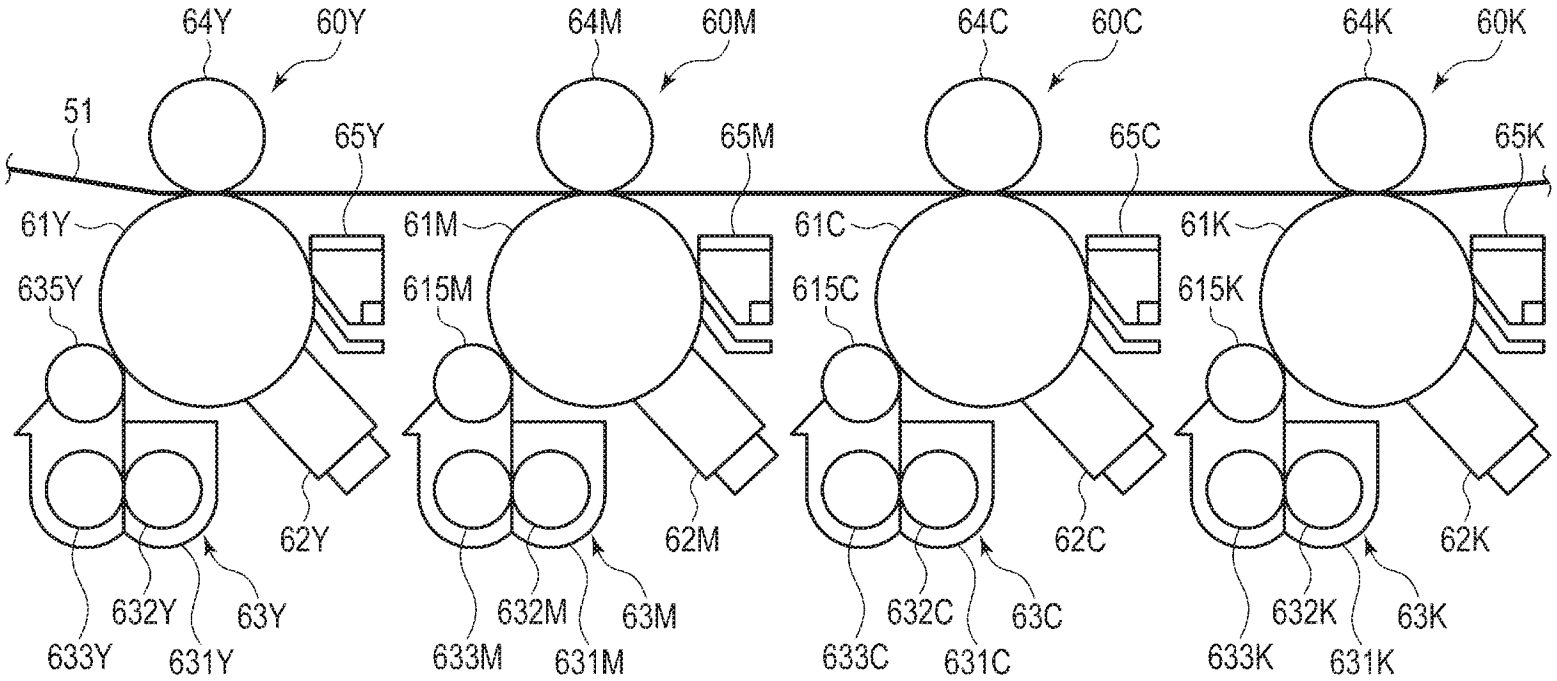
FIG. 2 is a vertical cross-sectional view showing a structure of an image forming station.
Figure 3:
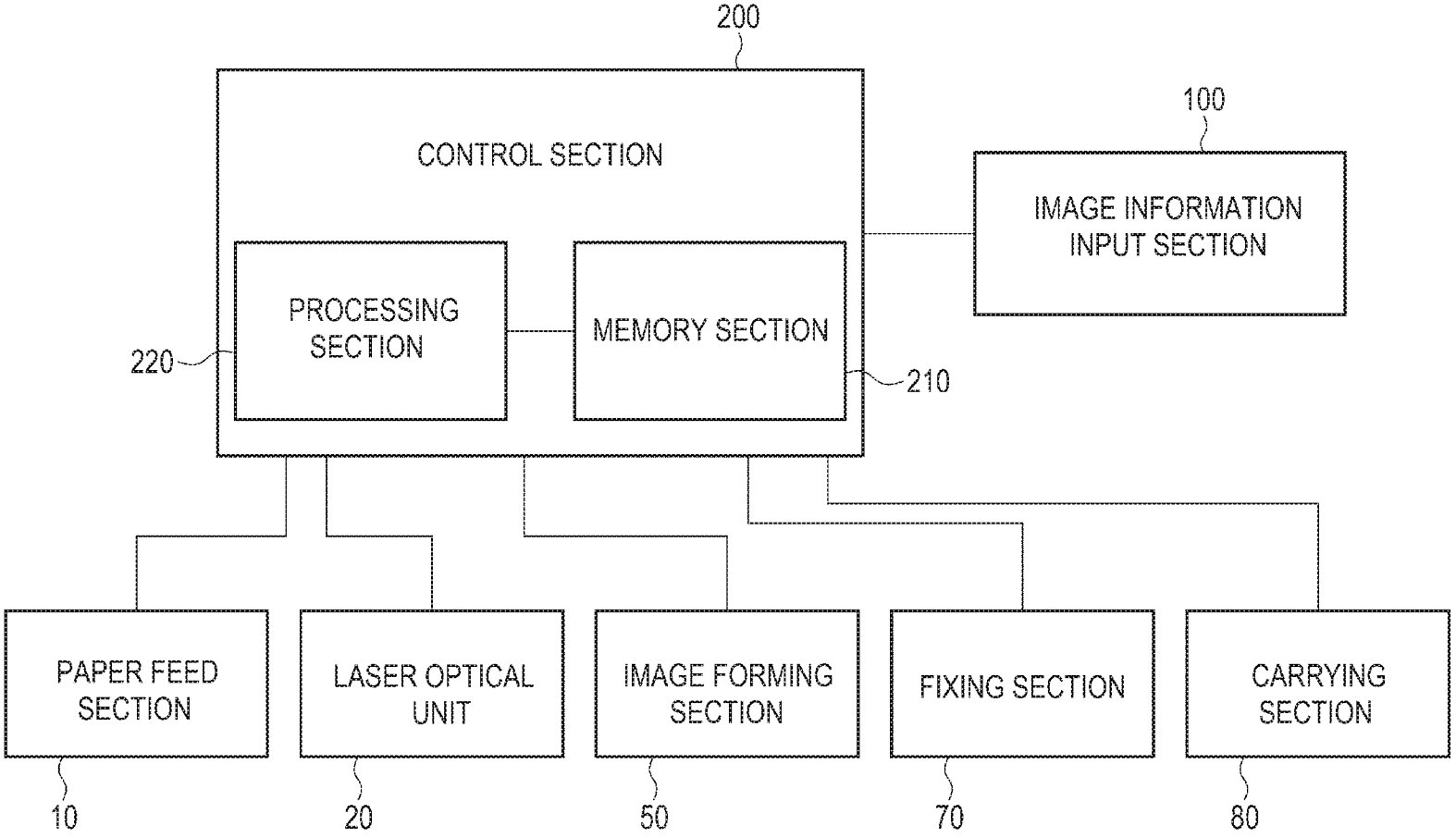
FIG. 3 is a block diagram showing a schematic structure of a control system.

One example of the image forming apparatus will be described with reference to FIGS. 1 to 3.

FIG. 1 is a vertical cross-sectional view schematically showing the overall structure of the image forming apparatus according to one example. FIG. 2 is a cross-sectional view schematically showing a structure of an image forming station included in the image forming apparatus shown in FIG. 1. FIG. 3 is a block diagram showing a schematic structure of a control system of the image forming apparatus shown in FIG. 1.

An image forming apparatus 1 shown in FIG. 1 is a color multi-functional peripheral (MFP). The image forming apparatus 1 includes a housing 2, a printer section 3 placed in the housing 2, and a scanner section 4 placed on the upper surface of the housing 2.

The printer section 3 forms an image on a recording medium, here, on a sheet such as a paper or a resin film by electrophotography. The printer section 3 includes a paper feed section 10, an optical unit 20, an image forming section 50, a fixing section 70, a carrying section 80, an image information input section 100, and a control section 200.

The paper feed section 10 includes a plurality of paper feed cassettes 11 and a plurality of pickup rollers 12. Each of these paper feed cassettes 11 stores stacked sheets. The pickup roller 12 feeds a sheet P which is the top layer among the sheets stored in the paper feed cassette 11 to the image forming section 50.

The optical unit 20 exposes the below-mentioned photoconductors 61Y, 61M, 61C, and 61K to light, and electrostatic latent images are formed on the surfaces thereof. As the optical unit 20, for example, a laser or a light-emitting diode (LED) can be used.

The image forming section 50 includes an intermediate transfer belt 51, a plurality of rollers 52, a secondary transfer roller 54, a backup roller 55, image forming stations 60Y, 60M, 60C, and 60K, hoppers 66Y, 66M, 66C, and 66K, and toner cartridges 67Y, 67M, 67C, and 67K. The below-mentioned primary transfer rollers 64Y, 64M, 64C, and 64K, the intermediate transfer belt 51, the plurality of rollers 52, the secondary transfer roller 54, and the backup roller 55 constitute a transfer device.

The intermediate transfer belt 51 temporarily holds toner images formed by the image forming stations 60Y, 60M, 60C, and 60K. The plurality of rollers 52 provide a tension to the intermediate transfer belt 51. The secondary transfer roller 54 drives the intermediate transfer belt 51. Between the secondary transfer roller 54 and the backup roller 55, a part of the intermediate transfer belt 51 is interposed. The backup roller 55 transfers the toner image formed on the intermediate transfer belt 51 to the sheet P along with the secondary transfer roller 54.

The image forming stations 60Y, 60M, 60C, and 60K have the same structure. That is, as shown in FIG. 2, the image forming station 60Y includes the photoconductor 61Y, a charger 62Y, a developing device 63Y, the primary transfer roller 64Y, and a cleaning unit 65Y. The image forming station 60M includes the photoconductor 61M, a charger 62M, a developing device 63M, the primary transfer roller 64M, and a cleaning unit 65M. The image forming station 60C includes the photoconductor 61C, a charger 62C, a developing device 63C, the primary transfer roller 64C, and a cleaning unit 65C. The image forming station 60K includes the photoconductor 61K, a charger 62K, a developing device 63K, the primary transfer roller 64K, and a cleaning unit 65K.

Here, the photoconductors 61Y, 61M, 61C, and 61K are photoconductive drums. The photoconductors 61Y, 61M, 61C, and 61K may be photoconductive belts. Further, here, for the image forming stations 60Y, 60M, 60C, and 60K, the photoconductors 61Y, 61M, 61C, and 61K are provided, respectively, however, one photoconductor may be provided for the image forming stations 60Y, 60M, 60C, and 60K.

The chargers 62Y, 62M, 62C, and 62K impart a negative charge to the photoconductors 61Y, 61M, 61C, and 61K, respectively, and uniformly charge the surfaces thereof with negative static electricity.

The developing device 63Y includes a developing container 631Y, developer mixers 632Y and 633Y, and a developing roller 635Y. The developer mixers 632Y and 633Y stir the developer in the developing container 631Y and also supply this developer to the developing roller 635Y. The developing roller 635Y supplies this developer to the photoconductor 61Y.

The developing device 63M includes a developing container 631M, developer mixers 632M and 633M, and a developing roller 635M. The developer mixers 632M and 633M stir the developer in the developing container 631M and also supply this developer to the developing roller 635M. The developing roller 635M supplies this developer to the photoconductor 61M.

The developing device 63C includes a developing container 631C, developer mixers 632C and 633C, and a developing roller 635C. The developer mixers 632C and 633C stir the developer in the developing container 631C and also supply this developer to the developing roller 635C. The developing roller 635C supplies this developer to the photoconductor 61C.

The developing device 63K includes a developing container 631K, developer mixers 632K and 633K, and a developing roller 635K. The developer mixers 632K and 633K stir the developer in the developing container 631K and also supply this developer to the developing roller 635K. The developing roller 635K supplies this developer to the photoconductor 61K.

The developing devices 63Y, 63M, 63C, and 63K supply a developer to the photoconductors 61Y, 61M, 61C, and 61K, respectively, to form toner images corresponding to the electrostatic latent images. One or two developing devices among the developing devices 63Y, 63M, 63C, and 63K can be omitted. Further, the image forming section 50 may further include one or more other developing devices in addition to the developing devices 63Y, 63M, 63C, and 63K. The developer and the toner will be described in detail later.

The primary transfer rollers 64Y, 64M, 64C, and 64K transfer the toner images on the photoconductors 61Y, 61M, 61C, and 61K to the intermediate transfer belt 51, respectively.

The cleaning units 65Y, 65M, 65C, and 65K clean a residue on the photoconductors 61Y, 61M, 61C, and 61K, respectively.

The hoppers 66Y, 66M, 66C, and 66K are placed above the developing devices 63Y, 63M, 63C, and 63K, respectively. The hoppers 66Y, 66M, 66C, and 66K replenish the developer to the developing devices 63Y, 63M, 63C, and 63K, respectively.

The toner cartridges 67Y, 67M, 67C, and 67K are detachably placed above the hoppers 66Y, 66M, 66C, and 66K, respectively. The toner cartridges 67Y, 67M, 67C, and 67K include toner cartridge bodies 671Y, 671M, 671C, and 671K, respectively. Each of the toner cartridge bodies 671Y, 671M, 671C, and 671K is one example of the container and stores the developer. The toner cartridges 67Y, 67M, 67C, and 67K supply the developer to the hoppers 66Y, 66M, 66C, and 66K, respectively.

The fixing section 70 includes a heating roller, a pressure member, a pad, a spring, and a stopper (all not shown). The fixing section 70 is placed at a position on a path where the carrying section 80 carries the sheet P and between the secondary transfer roller 54 and a paper discharge roller 83.

The carrying section 80 includes a resist roller 81, a carrying roller 82, a paper discharge roller 83, and a paper discharge tray 84. The resist roller 81 starts the carrying of the sheet P fed from the pickup roller 12 to the image forming section 50 at a predetermined timing. The carrying roller 82 carries the sheet P fed from the resist roller 81 so that the sheet P passes between the backup roller 55 and the intermediate transfer belt 51, and thereafter passes through the fixing section 70. The paper discharge roller 83 is located on a path where the sheet P is carried and immediately upstream of the position where the sheet P is discharged outside the printer section 3 and carries the sheet P to the paper discharge tray 84. The paper discharge tray 84 is located on the upper surface of the printer section 3 and receives the discharged sheet P.

The image information input section 100 takes in the image information to be printed on the sheet P which is a recording medium from an external recording medium or a network. The image information input section 100 supplies this image information to the control section 200.

The control section 200 includes a memory section 210 and a processing section 220. The memory section 210 includes, for example, a primary memory device (for example, Random Access Memory (RAM)) and a secondary memory device (for example, Read Only Memory (ROM)). The processing section 220 includes a processor (for example, Central Processing Unit (CPU)). The secondary memory device stores, for example, a program to be interpreted and executed by the processor. The primary memory device primarily stores, for example, the image information supplied from the image information input section 100 or the like, the program stored by the secondary memory device, and data or the like generated by the processing by the processor. The processor interprets and executes the program stored by the primary memory device. The control section 200 controls the operation of the paper feed section 10, the optical unit 20, the image forming section 50, the fixing section 70, the carrying section 80, etc. based on the image information supplied from the image information input section 100 or the like in this manner.

<<Developer>>

Next, the developer which can be used in the above-mentioned image forming apparatus 1 will be described.

In the image forming apparatus 1 described with reference to FIGS. 1 to 3, for example, a two-component developer containing a toner and a carrier can be used.

The carrier is not particularly limited, however, for example, a ferrite carrier can be used.

One of the toner cartridges 67Y, 67M, 67C, and 67K includes a first toner described below as the toner. Further, another one of the toner cartridges 67Y, 67M, 67C, and 67K includes a second toner described below as the toner. Here, as one example, it is assumed that the toner cartridge 67K includes the first toner, and the toner cartridge 67Y includes the second toner.

The first toner is stored in the first container, here, in the toner cartridge body 671K. The first toner includes a plurality of first toner particles containing a first bright pigment and a first binder resin.

The second toner is stored in the second container, here, in the toner cartridge body 671Y. The second toner includes a plurality of second toner particles containing a second bright pigment and a second binder resin, and has a larger volume average particle diameter than the first toner. Here, the "volume average particle diameter" means a 50% volume average particle diameter obtained by the measurement using an electrical sensing zone method (the Coulter Principle).

The first and second toners may be distributed separately or may be distributed as a toner set including these toners. In the toner set, each of the first and second toners may be mixed with a carrier. That is, the first and second toners may be distributed in the form of a developer set including a first developer containing the first toner and a first carrier and stored in the first container and a second developer containing the second toner and a second carrier and stored in the second container. In this case, according to one example, the first and second containers are the toner cartridge bodies 671K and 671Y, respectively. That is, the first and second toners may be distributed in the form of a toner cartridge set. Alternatively, each of the first and second containers may be a container other than the toner cartridge body.

Hereinafter, the first and second toners will be described in detail.

<First Toner>

The volume average particle diameter of the first toner is preferably within the range of 6 to 20 μm, more preferably within the range of 10 to 16 μm. When the volume average particle diameter is too small, it is hard to form a bright image with excellent brightness. When the volume average particle diameter is too large, it is hard to form a bright image with excellent concealability. The volume average particle diameter of the toner refers to the 50% volume average particle diameter of the toner obtained by externally adding an external additive to the toner particles. However, the volume average particle diameter of the toner particles before the external additive is added, that is, a mother toner (or toner core particles) and the volume average particle diameter of the toner obtained by externally adding an external additive to the toner particles are substantially the same.

The first toner includes a plurality of first toner particles containing a first bright pigment and a first binder resin. Hereinafter, these components will be described.

(First Binder Resin)

As the first binder resin, for example, a polyester-based resin, a styrene-acrylic-based resin, a polyurethane-based resin, or an epoxy-based resin can be used.

As the polyester-based resin, for example, a polyester-based resin obtained using, as a raw material monomer, a dihydric or higher hydric alcohol component and a divalent or higher valent carboxylic acid component such as a carboxylic acid, a carboxylic anhydride, or a carboxylic ester can be used.

As the divalent or higher valent carboxylic acid component, for example, an aromatic dicarboxylic acid such as terephthalic acid, phthalic acid, or isophthalic acid, or an aliphatic carboxylic acid such as fumaric acid, maleic acid, succinic acid, adipic acid, sebacic acid, glutaric acid, pimelic acid, oxalic acid, malonic acid, citraconic acid, or itaconic acid can be used.

As the dihydric or higher hydric alcohol component, for example, an aliphatic diol such as ethylene glycol, propylene glycol, 1,4-butanediol, 1,3-butanediol, 1,5-pentanediol, 1,6-hexanediol, neopentyl glycol, trimethylene glycol, trimethylolpropane, or pentaerythritol, an alicyclic diol such as 1,4-cyclohexanediol or 1,4-cyclohexanedimethanol, an ethylene oxide such as bisphenol A, or a propylene oxide adduct or the like can be used.

Further, the above-mentioned polyester components may be converted so as to have a crosslinked structure using a trivalent or higher valent carboxylic acid component or a trihydric or higher hydric alcohol component such as 1,2,4-benzenetricarboxylic acid (trimellitic acid) or glycerin. Further, as the first binder resin, a mixture of two or more types of polyester resins having different compositions may be used.

The polyester-based resin may be crystalline or amorphous.

The glass transition temperature of the polyester-based resin is preferably within the range of 35° C. to 70° C., more preferably within the range of 40° C. to 65° C. When the glass transition temperature is too low, the storage stability of the toner may be deteriorated. When the glass transition temperature is too high, the low-temperature fixability may be deteriorated.

As the styrene-acrylic-based resin, for example, a polymer of a styrene, a copolymer of a styrene and a diene, or a copolymer of a styrene and an alkyl (meth)acrylate can be used.

The first binder resin is not particularly limited, but is preferably a polyester-based resin. The polyester-based resin has a lower glass transition temperature than, for example, a styrene-based resin, and therefore, when the polyester-based resin is used as the first binder resin, more excellent low-temperature fixability can be achieved.

(First Bright Pigment)

The first bright pigment is a pigment which has a flat plate shape with brightness such as metallic luster or pearly luster.

As the first bright pigment, for example, a flaky powder composed of a metal such as aluminum, brass, bronze, nickel, stainless steel, or zinc, a coated flaky inorganic crystal substrate obtained by coating a flaky inorganic compound such as mica, barium sulfate, or a layered silicate with an inorganic oxide such as titanium oxide or yellow iron oxide, single crystal plate-like titanium oxide, a flaky powder composed of a basic carbonate, a flaky powder composed of bismuth oxychloride, a flaky powder composed of natural guanine, a flaky glass powder, or a metal-deposited flaky glass powder can be used.

The volume average particle diameter of the first bright pigment is preferably within the range of 5 to 15 μm, more preferably within the range of 8 to 10 μm. When the volume average particle diameter of the first bright pigment is too small, a sufficient decorative property may not be obtained. When the volume average particle diameter of the first bright pigment is too large, it may be hard to control the development, transfer, or the like. When the volume average particle diameter of the first bright pigment is within the above range, it is advantageous for obtaining particles which achieve a favorable decorative property and also facilitate the above-mentioned control.

As the first bright pigment, a commercially available product may be used. As the commercially available product, for example, Iriodin (registered trademark) 325 (Merck Corporation) can be used.

The amount of the first bright pigment is preferably within the range of 30 to 60 parts by mass, more preferably within the range of 40 to 50 parts by mass with respect to 100 parts by mass of the first binder resin. When the amount of the first bright pigment is within the above range, more excellent concealability is achieved.

<Second Toner>

The second toner is stored in the second container. The second toner has a larger volume average particle diameter than the first toner.

The volume average particle diameter of the second toner is preferably within the range of 10 to 30 μm, more preferably within the range of 15 to 25 μm. When the volume average particle diameter is too small, it is hard to form a bright image with excellent brightness. When the volume average particle diameter is too large, it is hard to form a bright image with excellent concealability.

The ratio of the volume average particle diameter of the second toner to the volume average particle diameter of the first toner is preferably within the range of 1.01 to 10.00, more preferably within the range of 1.10 to 2.0. When this ratio is small, the effect of using the first toner and the second toner in combination is small. When this ratio is too large, it may be hard to control the development, transfer, or the like.

The second toner includes a plurality of second toner particles containing a second bright pigment and a second binder resin. Hereinafter, these components will be described.

(Second Binder Resin)

The second binder resin may be the same as or different from the first binder resin. The second binder resin is preferably the same as the first binder resin from the viewpoint of fixability.

(Second Bright Pigment)

The second bright pigment is a pigment which has a flat plate shape with brightness such as metallic luster or pearly luster. As the second bright pigment, for example, those listed for the first bright pigment can be used.

The second bright pigment preferably exhibits brightness on the same principle as the first bright pigment, and is more preferably composed of the same material as the first bright pigment.

According to one example, when the first bright pigment exhibits metallic luster, also the second bright pigment exhibits metallic cluster. In this case, the materials of the first and second bright pigments are preferably the same.

According to another example, when the first bright pigment exhibits brightness by utilizing multiple reflection interference, for example, exhibits pearly luster, also the second bright pigment exhibits brightness by utilizing multiple reflection interference, for example, exhibits pearly luster. In this case, the first and second bright pigments are more preferably composed of the same material, for example, are a coated flaky inorganic crystal substrate obtained by coating mica with an inorganic oxide.

The volume average particle diameter measured using an electrical sensing zone method of the second bright pigment is preferably within the range of 5 to 25 μm, more preferably within the range of 10 to 22 μm. Further, the volume average particle diameter of the second bright pigment is preferably larger than the volume average particle diameter of the first bright pigment. When the volume average particle diameter of the second bright pigment is too small, a sufficient decorative property may not be obtained. When the volume average particle diameter of the second bright pigment is too large, it may be hard to control the development, transfer, or the like. When the volume average particle diameter of the second bright pigment is within the above range, it is advantageous for obtaining particles which achieve a favorable decorative property and also facilitate the above-mentioned control.

As the second bright pigment, a commercially available product may be used. As the commercially available product, for example, when Iriodin 325 is used as the first bright pigment, Iriodin 305 (Merck Corporation) can be used.

The amount of the second bright pigment is preferably within the range of 30 to 60 parts by mass, more preferably within the range of 40 to 50 parts by mass with respect to 100 parts by mass of the second binder resin. When the amount of the second bright pigment is within the above range, more excellent brightness is achieved.

<Release Agent>

The first and second toner particles may further contain a release agent. As the release agent, for example, a low-molecular weight polyethylene, a low-molecular weight polypropylene, a polyolefin copolymer, an aliphatic hydrocarbon-based wax such as a polyolefin wax, a microcrystalline wax, a paraffin wax, or a Fischer-Tropsch wax, or a modified material thereof, an oxide of an aliphatic hydrocarbon-based wax such as a polyethylene oxide wax, or a block copolymer thereof, a vegetable wax such as candelilla wax, carnauba wax, Japan wax, jojoba wax, or rice wax, an animal wax such as bees wax, lanolin, or spermaceti wax, a mineral wax such as montan wax, ozokerite, ceresin, or petrolactum, a wax containing a fatty acid ester as a main component such as a montanic ester wax or a castor wax, or a wax obtained by partially or entirely deoxidizing a fatty acid ester such as a deoxidized carnauba wax can be used. The release agent may be omitted.

When the release agent is used, the amount thereof is preferably within the range of 4 to 35 parts by mass, more preferably within the range of 6 to 20 parts by mass with respect to 100 parts by mass of the first or second mother toner, that is, the first or second toner particles.

(Charge Control Agent)

The first and second toner particles may further contain a charge control agent. As the charge control agent, for example, a metal-containing azo compound can be used. The metal-containing azo compound is a complex or a complex salt in which the metal element is, for example, iron, cobalt, or chromium. As the metal-containing azo compound, one type among these may be used alone or two or more types may be used. Further, as the charge control agent, for example, a metal-containing salicylic acid derivative compound can also be used. The metal-containing salicylic acid derivative compound is a complex or a complex salt in which the metal element is, for example, zirconium, zinc, chromium, or boron. As the metal-containing salicylic acid derivative compound, one type among these may be used alone or two or more types may be used. The charge control agent may be omitted.

When the charge control agent is used, the amount thereof is preferably within the range of 0.01 to 5.00 parts by mass, more preferably within the range of 0.1 to 2.0 parts by mass with respect to 100 parts by mass of the first or second mother toner.

(External Additive)

The first and second toners may further include an external additive carried on the surfaces of the first and second toner particles. As the external additive, for example, inorganic fine particles can be used. As the inorganic fine particles, for example, silica, titania, alumina, strontium titanate, tin oxide, or the like can be used. As the inorganic fine particles, one type among these may be used alone or two or more types may be used. The further external addition of the inorganic fine particles to the first and second toner particles is advantageous for adjusting the fluidity and chargeability of the first and second toners. Further, as the inorganic fine particles, those surface-treated with a hydrophobizing agent are preferably used. Such inorganic fine particles, for example, hydrophobic silica particles can be used. By using the inorganic fine particles surface-treated with a hydrophobizing agent, more excellent environmental stability can be achieved.

When the inorganic fine particles are used as the external additive, the amount thereof is preferably within the range of 0.1 to 10.0 parts by mass, more preferably within the range of 0.5 to 5.0 parts by mass with respect to 100 parts by mass of the first or second mother toner.

The first and second toners may further include resin fine particles with a size of 1 μm or less carried on the surfaces of the first and second toner particles. The external additive may be omitted.

When the resin fine particles are used as the external additive, the amount thereof is preferably within the range of 0.01 to 5.00 parts by mass, more preferably within the range of 0.1 to 2.0 parts by mass with respect to 100 parts by mass of the first or second mother toner.

<<Method for Producing Toner>>

The first and second toners are produced by, for example, the following method. That is, the method for producing the first and second toners includes a resin pulverization liquid preparation step S10, a wax pulverization liquid preparation step S11, a toner composition aggregate dispersion liquid preparation step S12, a toner particle drying step S13, and an external additive attaching step S14.

<Resin Pulverization Liquid Preparation Step S10>

In the resin pulverization liquid preparation step S10, a mixed liquid in which a binder resin, a surfactant, a pH adjusting agent, and water are mixed is prepared, followed by mechanical shearing.

The surfactant is not particularly limited, however, for example, an anionic surfactant such as a sulfate ester salt-based, sulfonate salt-based, phosphate ester salt-based, or fatty acid salt-based anionic surfactant, a cationic surfactant such as an amine salt-based or quaternary ammonium salt-based cationic surfactant, an amphoteric surfactant such as a betaine-based amphoteric surfactant, a nonionic surfactant such as a polyethylene glycol-based, alkyl phenol ethylene oxide adduct-based, or polyhydric alcohol-based nonionic surfactant, or a polymeric surfactant such as a polycarboxylic acid can be used. The further incorporation of the surfactant in the first and second toner particles is advantageous for enhancing the stability of the aggregated particles or the dispersion stability thereof. Further, when surfactants having opposite polarities are used simultaneously, these surfactants can have a function as an aggregating agent which will be described later. The surfactant may be omitted.

When the surfactant is used, the amount thereof is appropriately set according to the formulation and materials.

The pH adjusting agent is not particularly limited, however, for example, a basic compound such as sodium hydroxide, potassium hydroxide, or an amine compound, or an acidic compound such as hydrochloric acid, nitric acid, or sulfuric acid can be used. The pH adjusting agent may be omitted.

When the pH adjusting agent is used, the amount thereof is appropriately set according to the formulation and materials.

<Wax Pulverization Liquid Preparation Step S11>

In the wax pulverization liquid preparation step S11, a mixed liquid in which a release agent, a surfactant, a pH adjusting agent, and water are mixed is prepared, followed by mechanical shearing.

As the surfactant and the pH adjusting agent, those described above can be used.

<Toner Composition Aggregate Dispersion Liquid Preparation Step S12>

In the toner composition aggregate dispersion liquid preparation step S12, first, a resin-wax mixed liquid in which the resin pulverization liquid obtained by the resin pulverization liquid preparation step S10 and the wax pulverization liquid obtained by the wax pulverization liquid preparation step S11 are mixed is prepared. Then, aside from this, a pigment dispersion liquid in which an aggregating agent is added to a mixed liquid of the first or second bright pigment and water is prepared. Subsequently, while stirring the pigment dispersion liquid, the resin-wax mixed liquid is gradually added thereto, whereby a toner composition aggregate dispersion liquid is prepared.

The aggregating agent is not particularly limited, however, a monovalent metal salt such as sodium chloride, a polyvalent metal salt such as magnesium sulfate or aluminum sulfate, a nonmetal salt such as ammonium chloride or ammonium sulfate, an acid such as hydrochloric acid or nitric acid, or a strong cationic coagulating agent such as a polyamine or polydiallyldimethylammonium chloride (polyDADMAC) based coagulating agent can be used. The aggregating agent may be omitted.

When the aggregating agent is used, the amount thereof is appropriately set according to the formulation and materials.

<Toner Particle Drying Step S13>

In the toner particle drying step S13, the toner particles are washed and dried.

<External Additive Attaching Step S14>

Finally, in the external additive attaching step S14, an external additive is externally added to the dry toner particles. In the external additive attaching step S14, resin fine particles or inorganic fine particles, or both are externally added and mixed. By doing this, the first toner and the second toner are obtained.

Other Toners

In the toner cartridges other than the toner cartridges in which the first and second toners are stored among the toner cartridges 67Y, 67M, 67C, and 67K, third and fourth toners which are different from the first and second toners may be stored.

For example, as the third and fourth toners, bright toners which exhibit colors different from the first and second toners may be used. As such bright toners, for example, those described for the first and second toners can be used.

When bright toners are used as the third and fourth toners, the volume average particle diameter of the third toner and the volume average particle diameter of the fourth toner are preferably different from each other in the same manner as the first and second toners. In this case, these volume average particle diameters preferably satisfy the above-mentioned conditions described for the first and second toners.

Alternatively, as the third and fourth toners, non-bright toners which exhibit the same color or different colors may be used. When non-bright toners are used as the third and fourth toners, the size relationship of the volume average particle diameters thereof is not particularly limited. In the non-bright toner, for example, the following colorant can be used.

As the colorant to be contained in the third and fourth toners, for example, a carbon black can be used. As the carbon black, for example, acetylene black, furnace black, thermal black, channel black, or Ketjen black can be used.

As the colorant to be contained in the third and fourth toners, a pigment or a dye composed of an organic substance or an inorganic substance may be used. As the pigment or dye, for example, fast yellow G, benzidine yellow, indofast orange, irgaj in red, carmen FB, permanent bordeaux FRR, pigment orange R, lithol red 2G, lake red C, rhodamine FB, rhodamine B lake, phthalocyanine blue, pigment blue, brilliant green B, phthalocyanine green, or quinacridone can be used. As the colorant, among these, one type may be used alone or a mixture of two or more types may be used.

<<Image Forming Method>>

Next, an image forming method according to an embodiment will be described.

The image forming method according to this embodiment includes forming a first electrostatic latent image on a first photoconductor, forming a first toner image corresponding to the first electrostatic latent image on the first photoconductor, directly or indirectly transferring the first toner image onto a recording medium from the first photoconductor, forming a second electrostatic latent image having the same shape and dimension as the first electrostatic latent image on the first photoconductor or a second photoconductor which is different from the first photoconductor, forming a second toner image corresponding to the second electrostatic latent image on the first or second photoconductor, and forming a bright image in which the first and second toner images are superimposed on each other on the recording medium by directly or indirectly transferring the second toner image onto the recording medium from the first or second photoconductor.

Hereinafter, as one example, an image forming method using the image forming apparatus 1 described with reference to FIGS. 1 to 3 will be described.

First, for example, an operator inputs the information of an image including a portion to be formed with a toner containing a bright pigment (hereinafter referred to as "bright toner") to the image information input section 100 through a network or from an external recording medium. This image may be composed of only a portion to be formed with the bright toner, or may include a first portion to be formed with the bright toner and a second portion to be formed with a toner containing a non-bright pigment (hereinafter referred to as "non-bright toner"). Here, as one example, it is assumed that the above image includes the first and second portions, and the developer in the toner cartridge 67Y contains the second toner which is the bright toner, the developer in the toner cartridge 67M contains the non-bright toner, the developer in the toner cartridge 67C contains the non-bright toner, and the developer in the toner cartridge 67K contains the first toner which is the bright toner.

The image information input section 100 outputs this image information to the control section 200. The control section 200 controls the operation of the paper feed section 10, the optical unit 20, the image forming section 50, the fixing section 70, the carrying section 80, etc. based on this image information as follows.

First, the control section 200 controls the operation of the paper feed section 10 so that one pickup roller 12 feeds a sheet P which is the top layer among the sheets stored in the paper feed cassette 11 corresponding to this pickup roller 12 to the resist roller 81.

Further, the control section 200 controls the optical unit 20 and the image forming section 50 so that these members perform the following operations.

The secondary transfer roller 54 which is a drive roller rotates the intermediate transfer belt 51 in the counterclockwise direction in FIG. 1. The photoconductors 61Y, 61M, 61C, and 61K rotate in the clockwise direction in FIG. 1. The chargers 62Y, 62M, 62C, and 62K uniformly charge the surfaces of the photoconductors 61Y, 61M, 61C, and 61K, respectively. The optical unit 20 forms a second electrostatic latent image corresponding to the first portion on the surface of the photoconductor 61Y, forms a third electrostatic latent image corresponding to a part of the second portion on the surface of the photoconductor 61M, forms a fourth electrostatic latent image corresponding to the rest of the second portion on the surface of the photoconductor 61C, and forms a first electrostatic latent image corresponding to the first portion on the surface of the photoconductor 61K. The first and second electrostatic latent images have the same shape and dimension.

The developing device 63Y forms a second toner image corresponding to the second electrostatic latent image on the surface of the photoconductor 61Y. The developing device 63M forms a third toner image corresponding to the third electrostatic latent image on the surface of the photoconductor 61M. The developing device 63C forms a fourth toner image corresponding to the fourth electrostatic latent image on the surface of the photoconductor 61C. The developing device 63K forms a first toner image corresponding to the first electrostatic latent image on the surface of the photoconductor 61K. The primary transfer rollers 64Y, 64M, 64C, and 64K transfer the above toner images onto the intermediate transfer belt 51 from the photoconductors 61Y, 61M, 61C, and 61K, respectively.

The control section 200 controls the operation of the optical unit 20 and the image forming section 50 such that the first and second toner images are superimposed on each other on a first region corresponding to the first portion, the third toner image is located on a part of a second region corresponding to the second portion, and the fourth toner image is located on the rest of the second region on the surface of the intermediate transfer belt 51. The superimposed first and second toner images form a bright image.

Further, the control section 200 controls the operation of the image forming section 50 and the carrying section 80 so that when a portion corresponding to the first and second regions of the intermediate transfer belt 51 passes through the secondary transfer roller 54, the sheet P passes between the intermediate transfer belt 51 and the backup roller 55, and at this time, the first to fourth toner images on the intermediate transfer belt 51 are transferred onto the sheet P.

Thereafter, the control section 200 controls the operation of the fixing section 70 and the carrying section 80 so that the first to fourth toner images are fixed to the sheet P, and then, the sheet P is discharged to the paper discharge tray 84. As described above, a printed material including a bright image and a non-bright image is obtained.

The ratio of the amount of the second toner to be used for forming the second toner image to the amount of the first toner to be used for forming the first toner image is preferably within the range of 0.1 to 10, more preferably within the range of 1 to 10. When the ratio of the amount of the second toner to be used for forming the second toner image to the amount of the first toner to be used for forming the first toner image is within the above range, more excellent brightness is achieved.

Effect

When a bright toner having a large particle diameter is used, excellent brightness is expected to be exhibited. However, when an image is formed on the sheet P using only such a bright toner, inconvenience is likely to occur in development or transfer, and therefore, a gap is likely to occur in a portion where the bright toners are superimposed on each other on the sheet P. That is, in this case, there is still room for improvement on the concealability.

Further, when an image is formed on the sheet P using a bright toner having a small particle diameter, excellent concealability is expected. However, when only such a bright toner is used, also the particle diameter of the bright pigment is small, and therefore, high brightness as in the case where only a bright toner having a larger particle diameter is used cannot be achieved.

On the other hand, in the process described with reference to FIGS. 1 to 3, the first and second toner images formed using the first and second toners having different volume average particle diameters, respectively, are superimposed on each other on the sheet P. Therefore, excellent brightness and excellent concealability can be achieved simultaneously.

Further, in the above-mentioned process, the first toner image formed with the first toner having a smaller volume average particle diameter than the second toner is interposed between the sheet P and the second toner image. The second toner image may be interposed between the sheet P and the first toner image, however, when the first toner is interposed between the sheet P and the second toner image, an image which exhibits more excellent brightness can be formed.

The above-mentioned image forming apparatus 1 includes the intermediate transfer belt 51, however, the image forming apparatus 1 may be an image forming apparatus which adopts a direct transfer system. Further, in the above-mentioned image forming apparatus 1, four image forming stations 60Y, 60M, 60C, and 60K are arranged, however, only one image forming station may be provided. In this case, for example, a plurality of developing devices are arranged around one photoconductor.

Further, in the above-mentioned image forming apparatus 1, the toner cartridges 67Y, 67M, 67C, and 67K are detachably placed above the hoppers 66Y, 66M, 66C, and 66K, however, the following form may be adopted. For example, the image forming apparatus 1 may include the toner cartridges 67Y, 67M, 67C, and 67K integrally with the developing devices 63Y, 63M, 63C, and 63K, respectively, and may detachably include this unit. According to another example, the image forming apparatus 1 may include the toner cartridges 67Y, 67M, 67C, and 67K integrally with the developing devices 63Y, 63M, 63C, and 63K, respectively, and also with the photoconductors 61Y, 61M, 61C, and 61K, respectively, and may detachably include this unit.

EXAMPLES

Hereinafter, specific examples of the embodiments will be described.

(Production of Bright Toner T1)

A bright toner T1 was produced by the following method.

First, a resin pulverization liquid was prepared. That is, 30 parts by mass of a polyester-based resin as a binder resin, 3 parts by mass of sodium dodecylbenzenesulfonate as an anionic surfactant, 1 part by mass of triethylamine as a pH adjusting agent, and 66 parts by mass of water were mixed at room temperature. Thereafter, the temperature of the mixed liquid was increased to 80° C., and the mixed liquid was subjected to mechanical shearing for 30 minutes. Specifically, CLEARMIX (registered trademark) was used as a dispersion emulsification machine, and the mechanical shearing was performed by setting the rotation speed of the machine to 6000 rpm. After completion of the mechanical shearing, the temperature of the mixed liquid was decreased to normal temperature.

The volume average particle diameter of the particles included in the obtained resin pulverization liquid was measured by a laser diffraction scattering method. In the measurement performed here, and in the measurement of a volume average particle diameter by a laser diffraction scattering method described below, SALD-7000 (Shimadzu Corporation) was used. As a result, the volume average particle diameter was 0.16 μm.

Subsequently, a wax pulverization liquid was prepared. That is, 40 parts by mass of an ester wax as a release agent, 4 parts by mass of sodium dodecylbenzenesulfonate as an anionic surfactant, 1 part by mass of triethylamine as a pH adjusting agent, and 55 parts by mass of water were mixed at room temperature. Thereafter, the temperature of the mixed liquid was increased to 80° C., and the mixed liquid was subjected to mechanical shearing for 30 minutes by setting the rotation speed of the dispersion emulsification machine to 6000 rpm. After completion of the mechanical shearing, the temperature of the mixed liquid was decreased to normal temperature.

The volume average particle diameter of the obtained wax pulverization liquid was measured by a laser diffraction scattering method. As a result, the volume average particle diameter was 0.20 μm.

50 Parts by mass of the resin pulverization liquid, 8 parts by mass of the wax pulverization liquid, and 42 parts by mass of water were placed in a flask, followed by stirring, whereby a resin-wax mixed liquid was prepared.

Subsequently, a pigment dispersion liquid was prepared by the following method.

First, 31 parts by mass of Iriodin 305 as a bright pigment and 589 parts by mass of water were stirred at a stirring speed of 500 rpm at room temperature. The stirring under such conditions was maintained until the below-mentioned toner particle dispersion liquid was obtained.

Subsequently, 25 parts by mass of a 0.5% polydiallyldimethylammonium chloride solution as an aggregating agent was added to this mixed liquid. Then, the temperature of the mixed liquid was increased to 45° C. Subsequently, 50 parts by mass of an aqueous 30% ammonium sulfate solution as an aggregating agent was added to this mixed liquid. Then, stirring was continued for 1 hour while maintaining the temperature and the stirring speed under the above-mentioned conditions. By doing this, a pigment dispersion liquid was obtained.

Subsequently, 250 parts by mass of the resin-wax mixed liquid described above was added to the pigment dispersion liquid from the upper side thereof at a rate of 0.5 parts by mass/min. The addition of the resin-wax mixed liquid was performed using a liquid feed pump capable of controlling the flow rate of the mixed liquid to be added, here, a Masterflex tubing pump system (Yamato Scientific Co., Ltd., inner diameter of tube: 0.8 mm). By doing this, the bright pigment particles were coated with the binder resin and the release agent.

Further, 26 parts by mass of an aqueous 30% ammonium sulfate solution as an aggregating agent was added to this mixed liquid. Then, a mixed liquid composed of 80 parts by mass of the resin pulverization liquid and 80 parts by mass of water was added to the mixed liquid from the upper side thereof at a rate of 0.5 parts by mass/min using the liquid feed pump. By doing this, a toner composition aggregate dispersion liquid was obtained.

Subsequently, to this toner composition aggregate dispersion liquid, 10 parts by mass of a polycarboxylic acid-based surfactant (POIZ (registered trademark) 520, Kao Corporation) was added as a surfactant, and the temperature of the dispersion liquid was increased to 65° C., whereby the particles were partially fused. By doing this, a toner particle dispersion liquid was obtained.

Subsequently, the toner particle dispersion liquid was washed and dried. Specifically, filtration of the toner particle dispersion liquid and washing with water were repeatedly performed until the electrical conductivity of the filtrate was decreased to 50 μS/cm or less. Thereafter, the toner particles were dried using a vacuum dryer until the water content therein was decreased to 1.0 mass % or less.

Finally, 2 parts by mass of hydrophobic silica and 0.75 parts by mass of titanium oxide as external additives were added with respect to 100 parts by mass of the dry toner particles and externally added thereto using a Henschel (registered trademark) mixer as a mixing machine, whereby a bright toner T1 was obtained. The volume average particle diameter of the obtained bright toner T1 was measured by an electrical sensing zone method. In the measurement performed here, and in the measurement of the volume average particle diameter of a toner by an electrical sensing zone method described below, Multisizer 3 (Coulter Counter) was used. As a result, the volume average particle diameter was 19.99 μm.

(Production of Bright Toner T2)

A bright toner T2 was obtained in the same manner as the method for producing the bright toner T1 except that the stirring speed in the preparation of the pigment dispersion liquid and the subsequent step was changed from 500 rpm to 600 rpm. The volume average particle diameter of the bright toner T2 was 18.07 μm.

(Production of Bright Toner T3)

A bright toner T3 was obtained in the same manner as the method for producing the bright toner T1 except that the bright pigment was changed from Iriodin 305 to Iriodin 325. The volume average particle diameter of the bright toner T3 was 15.38 μm.

(Production of Bright Toner T4)

A bright toner T4 was obtained in the same manner as the method for producing the bright toner T3 except that the stirring speed in the preparation of the pigment dispersion liquid and the subsequent step was changed from 500 rpm to 600 rpm. The volume average particle diameter of the bright toner T4 was 14.87 μm.

By using the bright toners T1 to T4 obtained by the above-mentioned methods, image formation was performed as follows. Here, image formation was performed using the image forming apparatus 1 described with reference to FIGS. 1 to 3.

Example 1

Image formation was performed using the bright toner T1 and the bright toner T3.

In the toner cartridge body 671K, a two-component developer containing the bright toner T1 and a ferrite carrier was filled. In this two-component developer, the ratio of the mass of the bright toner T1 to the mass of the ferrite carrier (toner ratio concentration) was 10%. Hereinafter, this two-component developer is referred to as "developer A".

In the toner cartridge body 671Y, a two-component developer containing the bright toner T3 and a ferrite carrier was filled. In this two-component developer, the ratio of the mass of the bright toner T3 to the mass of the ferrite carrier (toner ratio concentration) was 10%. Hereinafter, this two-component developer is referred to as "developer B".

By the method described with reference to FIGS. 1 to 3, a bright solid patch image in which a toner image formed using the developer A and a toner image formed using the developer B were superimposed on each other was formed on a sheet P in a normal temperature and normal humidity environment. Here, as the image forming apparatus 1, an electrophotographic MFP (e-studio 3555*c*, Toshiba Tec Corporation) was used. Further, in the formation of the above-mentioned toner images, the developers A and B were each used in an amount of 50 parts by mass. Further, the total amount of the toner attached in a region where the image was formed in the recording medium was set to 0.60 mg/cm$^2$. The ratio of the volume average particle diameter of the bright toner T1 to the volume average particle diameter of the bright toner T3 was 1.30.

Example 2

An image was formed in the same manner as in Example 1 except that the bright toner T4 was used in place of the bright toner T3. The ratio of the volume average particle diameter of the bright toner T1 to the volume average particle diameter of the bright toner T4 was 1.34.

Example 3

An image was formed in the same manner as in Example 1 except that the bright toner T2 was used in place of the bright toner T1. The ratio of the volume average particle diameter of the bright toner T2 to the volume average particle diameter of the bright toner T3 was 1.15.

Example 4

An image was formed in the same manner as in Example 1 except that the bright toner T3 was used in place of the bright toner T1, and the bright toner T2 was used in place of the bright toner T3. The ratio of the volume average particle diameter of the bright toner T2 to the volume average particle diameter of the bright toner T3 was 1.15.

Example 5

An image was formed in the same manner as in Example 4 except that the bright toner T1 was used in place of the bright toner T2. The ratio of the volume average particle diameter of the bright toner T1 to the volume average particle diameter of the bright toner T3 was 1.30.

Example 6

An image was formed in the same manner as in Example 5 except that the bright toner T4 was used in place of the bright toner T3. The ratio of the volume average particle diameter of the bright toner T1 to the volume average particle diameter of the bright toner T4 was 1.34.

Example 7

An image was formed in the same manner as in Example 6 except that the bright toner T2 was used in place of the bright toner T1. The ratio of the volume average particle diameter of the bright toner T2 to the volume average particle diameter of the bright toner T4 was 1.22.

Example 8

An image was formed in the same manner as in Example 3 except that the bright toner T1 was used in place of the bright toner T3. The ratio of the volume average particle diameter of the bright toner T1 to the volume average particle diameter of the bright toner T2 was 1.11.

Comparative Example 1

An image was formed in the same manner as in Example 8 except that the bright toner T2 was used in place of the bright toner T1. That is, in this example, the same developer was used in the toner cartridge bodies 671K and 671Y. Therefore, in this example, the ratio of the volume average particle diameter described above was 1.00.

Comparative Example 2

An image was formed in the same manner as in Example 4 except that the bright toner T3 was used in place of the bright toner T2. That is, also in this example, the same developer was used in the toner cartridge bodies 671K and 671Y. Therefore, also in this example, the ratio of the volume average particle diameter described above was 1.00.

Comparative Example 3

An image was formed in the same manner as in Example 1 except that the developer was not filled in the toner cartridge 67Y.

Comparative Example 4

An image was formed in the same manner as in Example 2 except that the developer was not filled in the toner cartridge 67K.

Evaluation

With respect to the images formed in Examples 1 to 8 and Comparative Examples 1 to 4, brightness and concealability were evaluated. The results are shown in Table 1.

TABLE 1

| | Volume average particle diameter of toner particles (μm) | | Ratio of average | | | |
|---|---|---|---|---|---|---|
| | First toner | Second toner | particle diameter | Stacking order on recording medium | Brightness | Concealability |
| Example 1 | 15.38 | 19.99 | 1.30 | second toner → first toner | B | A |
| Example 2 | 14.87 | 19.99 | 1.34 | second toner → first toner | B | A |
| Example 3 | 15.38 | 18.07 | 1.15 | second toner → first toner | B | A |
| Example 4 | 15.38 | 18.07 | 1.15 | first toner → second toner | A | A |
| Example 5 | 15.38 | 19.99 | 1.30 | first toner → second toner | A | A |
| Example 6 | 14.87 | 19.99 | 1.34 | first toner → second toner | A | A |
| Example 7 | 14.87 | 18.07 | 1.22 | first toner → second toner | A | A |
| Example 8 | 18.07 | 19.99 | 1.11 | first toner → second toner | A | B |
| Comparative Example 1 | — | 18.07 | 1.00 | second toner → second toner | A | C |
| Comparative Example 2 | 15.38 | — | 1.00 | first toner → first toner | C | A |

TABLE 1-continued

| | Volume average particle diameter of toner particles (μm) | | Ratio of average | | | |
|---|---|---|---|---|---|---|
| | First toner | Second toner | particle diameter | Stacking order on recording medium | Brightness | Concealability |
| Comparative Example 3 | — | 19.99 | — | second toner | A | C |
| Comparative Example 4 | 14.87 | — | — | first toner | C | A |

(Evaluation of Brightness)

The brightness of the obtained images was evaluated by visual observation. In Table 1, a sample which could be confirmed to have brightness at a glance is shown as "A", a sample which could be confirmed to have brightness when the printed material was observed while changing the observation angle is shown as "B", and a sample which could be confirmed to have low brightness when the printed material was observed while changing the observation angle is shown as "C".

(Evaluation of Concealability)

With respect to the samples used for the evaluation of brightness, observation and image acquisition were performed using an optical microscope.

A lens with a magnification of 10× was used as an ocular lens, and a lens with a magnification of 10× was used as an objective lens. Then, by using an image analysis software ImageJ, the area ratio of a bright pigment portion to the entire printed image region was determined from the obtained image.

In Table 1, a sample in which the area ratio of a bright pigment portion was 60% or more is shown as "A", a sample in which the area ratio of a bright pigment portion was 50% or more and less than 60% is shown as "B", and a sample in which the area ratio of a bright pigment portion was less than 50% is shown as "C".

As shown in Table 1, when a toner set including the first toner and the second toner having a larger volume average particle diameter than the first toner was used, excellent brightness and excellent concealability were achieved simultaneously.

Further, when a bright image was formed such that the first toner image was interposed between the recording medium and the second toner image, particularly excellent brightness and excellent concealability were achieved simultaneously.

The invention is not limited to the embodiments described above and can be modified variously without departing from the gist of the invention when it is practiced. Also, the respective embodiments may be appropriately combined and carried out, and combined effects can be obtained in this case. Further, the embodiments described above include various inventions, and various inventions can be extracted based on combinations selected from a plurality of disclosed constituent elements. For example, even if several constituent elements are deleted from all the constituent elements disclosed in the embodiments, a structure in which the constituent elements are deleted can be extracted as the invention when the problem can be solved and the effect can be obtained.

What is claimed is:

1. An image forming method, comprising:

forming a first electrostatic latent image on a first photoconductor;

forming a first toner image corresponding to the first electrostatic latent image on the first photoconductor by supplying a first toner which comprises a plurality of first toner particles containing a first bright pigment and a first binder resin to the first photoconductor;

directly or indirectly transferring the first toner image onto a recording medium from the first photoconductor;

forming a second electrostatic latent image having the same shape and dimension as the first electrostatic latent image on a second photoconductor which is different from the first photoconductor;

forming a second toner image corresponding to the second electrostatic latent image on the second photoconductor by supplying a second toner which comprises a plurality of second toner particles containing a second bright pigment and a second binder resin and has a larger volume average particle diameter than a volume average particle diameter of the first toner to the second photoconductor having the second electrostatic latent image formed thereon; and forming a bright image in which the first and second toner images are superimposed on each other on the recording medium by directly or indirectly transferring the second toner image onto the recording medium from the second photoconductor, wherein the first toner image formed with the first toner having the smaller volume average particle diameter than the volume average particle diameter of the second toner is interposed between the recording medium and the second toner image.

2. The method according to claim 1, wherein the bright image is formed by the interposing of the first toner image between the recording medium and the second toner image.

3. The method according to claim 1, wherein the ratio of the volume average particle diameter of the second toner to the volume average particle diameter of the first toner is within the range of 1.01 to 10.00.

4. The method according to claim 1, wherein the ratio of the volume average particle diameter of the second toner to the volume average particle diameter of the first toner is within the range of 1.10 to 2.0.

5. The method according to claim 1, wherein the ratio of the volume average particle diameter of the second toner to the volume average particle diameter of the first toner is within the range of 1.11 to 1.34.

6. The method according to claim 1, wherein the volume average particle diameter of the first toner is within the range of 6 to 20 μm.

7. The method according to claim 1, wherein the volume average particle diameter of the first toner is within the range of 10 to 16 μm.

8. The method according to claim 1, wherein the volume average particle diameter of the second toner is within the range of 10 to 30 μm.

9. The method according to claim 1, wherein the volume average particle diameter of the second toner is within the range of 15 to 25 μm.

10. The method according to claim 1, wherein the first bright pigment and the second bright pigment each exhibits metallic luster, or wherein the first bright pigment and the second bright pigment each exhibits pearly luster.

* * * * *